US011553810B2

(12) United States Patent
Jiang et al.

(10) Patent No.: US 11,553,810 B2
(45) Date of Patent: Jan. 17, 2023

(54) CURTAIN REMOTE CONTROLLER AND A METHOD FOR SETTING REMOTE CONTROL STROKE THEREOF

(71) Applicant: NINGBO SUNFREE MOTOR TECHNOLOGY COMPANY LIMITED, Ningbo (CN)

(72) Inventors: Chun Jiang, Ningbo (CN); Baowen Tan, Ningbo (CN)

( * ) Notice: Subject to any disclaimer, the term of this patent is extended or adjusted under 35 U.S.C. 154(b) by 247 days.

(21) Appl. No.: 16/985,222

(22) Filed: Aug. 5, 2020

(65) Prior Publication Data

US 2021/0045565 A1 Feb. 18, 2021

(30) Foreign Application Priority Data

Aug. 16, 2019 (CN) ..... 201921337651.4

(51) Int. Cl.

| | |
|---|---|
| ***A47H 5/032*** | (2006.01) |
| ***E06B 9/68*** | (2006.01) |
| ***G08C 17/00*** | (2006.01) |
| *A47H 5/02* | (2006.01) |

(52) U.S. Cl.

CPC ..... *A47H 5/0325* (2013.01); *E06B 9/68* (2013.01); *G08C 17/00* (2013.01); *A47H 2005/025* (2013.01); *E06B 2009/6809* (2013.01)

(58) Field of Classification Search

CPC ..... G06F 3/0219; G08C 17/02; G08C 17/00; H04N 21/42204; A47H 5/0325; A47H 2005/025; E06B 9/68; E06B 2009/3222; E06B 2009/6809; E06B 9/322; E06B 9/72

See application file for complete search history.

(56) References Cited

U.S. PATENT DOCUMENTS

| | | | | |
|---|---|---|---|---|
| 2017/0243475 | A1* | 8/2017 | Zhang | H04W 4/80 |
| 2019/0040676 | A1* | 2/2019 | Mullet | E06B 9/322 |

* cited by examiner

*Primary Examiner* — Omer S Khan

(57) ABSTRACT

A curtain remote controller and a method for setting remote control stroke thereof are provided, and the curtain remote controller controls the curtain driving motor through remote-control buttons; the managing buttons are used to set the upper and lower stroke interval of the curtain, so that the curtain moves within the interval and free adjustment of the stroke interval according to specific requirements is achieved. Meanwhile, the curtain remote controller adopts a conversion switch to form the remote control module and the setting module of the curtain remote controller, so that the function modules of the buttons are clearly divided to avoid situations such as the user is confused by too many buttons; it is convenient for users to identify each function module with a simple operation interface; the logical relationship of the curtain remote controller is simplified, and misoperation of the user is avoided.

5 Claims, 4 Drawing Sheets

CURTAIN REMOTE CONTROLLER AND A METHOD FOR SETTING REMOTE CONTROL STROKE THEREOF

CROSS-REFERENCE TO RELATED APPLICATIONS

This application claims priority to Chinese Patent Application No. 201921337651.4 with a filing date of Aug. 16, 2019. The content of the aforementioned application, including any intervening amendments thereto, are incorporated herein by reference.

TECHNICAL FIELD

The present invention relates to the technical field of smart home control, in particular to a curtain remote controller and a method for setting remote control stroke thereof.

BACKGROUND

A curtain is an essential product in daily life, and is mainly functioned as protection of personal privacy as well as sun shading and dust blocking. The traditional curtain needs to be manually opened or closed. In order to make it more convenient for users away from the curtain to control the curtain, a remote controller is introduced into the market. However, the existing remote controller usually adopts a control method of a single-button with multi-functions and combination button to simplify the interface of the curtain remote controller, which results in the complication of the control mode of the curtain remote controller, causing confusion and misusage. The control buttons on the curtain remote controller panel is not intuitive to the users, making it very inconvenient and error-prone to operate.

In addition, besides controlling the fully opening or closing of the curtain, the existing remote controller controls the curtain to open or close in a fixed interval by stopping the curtain when reaches the corresponding position by people staring at the curtain in real time. This kind of remote control is not convenient enough since it requires people to stare all the time until the curtain reach specific position. There are also remote controllers with setting to cover fixed stroke point of a curtain but contains very complicated setting steps. A user needs to be familiar with the parallel relations of various commands in the manual, otherwise, it's easy to cause confusion and misoperation.

SUMMARY

One objective of the present disclosure is to overcome the shortcomings of the prior arts by providing a curtain remote controller and a method for setting remote control stroke thereof, which solves the problem of operation confusion caused by the multi-function usage of the button on the curtain remote controller mentioned in the background technology, and the problem that the steps to set fixed stroke of the curtain are complicated and difficult to be understood.

To achieve the above objectives, the technical solution of the present disclosure is as follows: a curtain remote controller, comprising a remote controller body, and the curtain remote controller body is provided with a circuit board, a remote-control button, a managing button and a conversion switch for switching the function modules of the curtain remote controller; the conversion switch, the remote-control button and the managing button are all connected with the circuit board.

Preferably, the curtain remote controller further comprises a driving motor for controlling the lifting of the curtain, and the driving motor is provided with a signal receiver for frequency-to-frequency connection, and an M control button for entering the pairing mode; the curtain remote controller body is provided with a display screen and a power supply and a signal transmitter for frequency-to-frequency connection; the signal transmitter, the display screen and the power supply are connected with the circuit board; in addition, a mounting part is integrally formed on the back surface of the curtain remote controller body; the conversion switch and the managing button are arranged at the mounting part; a mounting cover is detachably connected to the mounting part; the remote-control button is arranged on the front surface of the curtain remote controller body; the conversion switch comprises an admin interface for entering an administrator mode and a user interface for entering a user mode; the admin interface and the user interface of the conversion switch are connected with the circuit board. By arranging the remote-control button and the managing button on the front and back surface of the remote control body respectively, the functions of the remote-control buttons can be clearly separated so as to prevent the user from using the buttons incorrectly; moreover, by hiding the managing button on the back surface of the curtain remote controller body, potential misoperation of a child may be avoided.

Preferably, the circuit board is provided with a trigger component corresponding to the remote-control buttons and the managing button; the remote-control button and the managing button are both connected with the circuit board through the trigger component; meanwhile, the remote-control buttons comprise a go-up button, a go-down button, a stop button and a light-adjusting button; the managing buttons comprise at least one stroke button, an S control button, and a channel button for switching signal channels, and the channel button is arranged on the front surface of the curtain remote controller body.

Preferably, the stroke button on the curtain remote controller body is provided with an upper stroke button and a lower stroke button.

The method for setting remote control stroke of any one of the above curtain remote controllers comprises the following steps:

S1, connect the curtain remote controller and the driving motor for pairing and matching.

S2, select the admin interface with the conversion switch to make the curtain remote controller enter the administrator mode, and then set the upper stroke point of the curtain upper limit and the lower stroke point of the curtain lower limit through the driving motor controlled by the upper stroke button and the lower stroke button on the curtain remote controller.

S3, select the user interface with the conversion switch to make the curtain remote controller enter the user mode, and then control the driving motor with the go-up button, the go-down button, and the stop button on the curtain remote controller to drive the curtain to ascend, descend or stop.

Preferably, the specific content of the pairing and matching connection of the curtain remote controller and the driving motor in the S1 comprises:

S11, connect the driving motor to a power supply, and then press and hold the M control button for a preset time duration to control the driving motor to enter the pairing state and feed signal back.

S12, select the admin interface with the conversion switch to enter the administrator mode, and select a channel that needs to be matched with the corresponding driving motor for frequency matching with the channel button on the curtain remote controller; then press and hold the S control button for a preset time duration; the pairing and matching connection of the curtain remote controller and the driving motor is completed, and meanwhile, the driving motor also gives the user a signal feedback of the successful frequency matching connection.

Preferably, the specific content to set the stroke point through the driving motor remotely controlled by the stroke buttons on the curtain remote controller in S2 comprises:

S21, select the admin interface with the conversion switch to make the curtain remote controller enter the administrator mode.

S22, control the driving motor to drive the curtain to rise to the desired upper stroke point and stop by the go-up button, then long press the upper stroke button for a preset time duration, and the driving motor gives a signal feedback indicating that the upper stroke point is successfully set.

S23, control the driving motor to drive the curtain to descend to the desired lower stroke point and stop by the go-down button; then long press the lower stroke button for a preset time duration, and the driving motor gives a signal feedback indicating that the lower stroke point is successfully set.

S24, finally, select the user interface with the conversion switch to make the curtain remote controller enter the user mode, the stroke setting of the driving motor controlled by the curtain remote controller is successfully saved.

Preferably, a third stroke point can be further set by the curtain remote controller if required:

Select the user interface with the conversion switch to make the curtain remote controller enter the user mode.

Adjust the curtain to a commonly used position for sun-shading effect through the go-up button, the go-down button and the stop button.

Then, long press the upper stroke button and the lower stroke button at the same time for a preset time duration, and the driving motor gives the user a signal feedback indicating that the third stroke point is successfully set.

If the position of the third stroke point needs to be changed, the user can adjust it to the other point with the go-up button, the go-down button and the stop button, then long press the upper stroke button and the lower stroke button at the same time for a preset time duration, and the driving motor gives the user a signal feedback indicating that the third stroke point is successfully changed.

Preferably, the curtain remote controller can also delete the matching with the driving motor, and specifically:

Select the admin interface with the conversion switch to enter the administrator mode, press the S control button for a preset number of times; when the driving motor has a signal feedback, it means that the curtain remote controller is disconnected from the corresponding driving motor.

In addition, when the curtain remote controller is connected with a plurality of driving motors through multiple channels, the remaining channels can be locked and hidden, and the specific setting method is as follows:

Select the user interface with the conversion switch to enter the user mode, and long press all the channel buttons at the same time for a preset time duration, when all the channel ranges are displayed on the display screen, select the range of the channel to be used by the channel button, and press the stop button to confirm. The currently available channel is displayed on the display screen.

Preferably, the speed of the driving motor can also be adjusted by the curtain remote controller, and the specific operation is as follows:

Increase the speed of the driving motor: long press the go-up button and the stop button at the same time for a preset time duration, and the driving motor gives a signal feedback that the speed has been increased successfully.

Reduce the speed of the driving motor: long press the go-down button and the stop button at the same time for a preset time duration, and the driving motor gives a signal feedback that the speed has been reduced successfully.

Compared with the prior art, the present invention has the beneficial effects that the curtain remote controller controls the curtain driving motor through remote-control buttons, and the managing buttons are used to set the upper and lower stroke interval of the curtain, so that the curtain moves within the interval and free adjustment of the stroke interval according to specific requirements is achieved. Meanwhile, the curtain remote controller adopts a conversion switch to form the remote control module and the setting module of the curtain remote controller, so that the function modules of the buttons are clearly divided to avoid situations such as the user is confused by too many buttons; it is convenient for users to identify each function module with a simple operation interface; the logical relationship of the curtain remote controller is simplified, and misoperation of the user is avoided.

In the figures: 1 remote controller body, 1-1 circuit board, 1-2 remote-control button, 1-2-1 go-up button, 1-2-2 go-down button, 1-2-3 stop button, 1-2-4 light-adjusting button, 1-3 managing button, 1-3-1 upper stroke button, 1-3-2 lower stroke button, 1-3-3 S control button, 1-3-4 channel button, 1-4 conversion switch, 1-5 display screen, 1-6 power supply, 1-7 mounting part, 1-8 mounting cover, 1-9 upper cover shell, 1-10 lower cover shell, 1-11 clamping groove, 1-12 block,

1-13 mounting slot, 2 driving motor, 2-1 power switch, 2-2 M control button, 3 trigger component, 4 base.

EMBODIMENTS

Various aspects of the illustrative embodiments herein will be described below using terms commonly employed by those skilled in the art to convey the substance of their work to others stilled in the art. However, it will be apparent to those skilled in the art that alternate embodiments may be practiced with only some of the described aspects. For purposes of explanation, specific numbers, material and configuration are set forth in order to prove a thorough understanding of the illustrative embodiments. However, it will be apparent to one skilled in the art that alternate embodiments may be practiced without the specific details.

In other instances, well-known features are omitted or simplified in order not to obscure the illustrative embodiments.

Embodiment One

Figure 1:
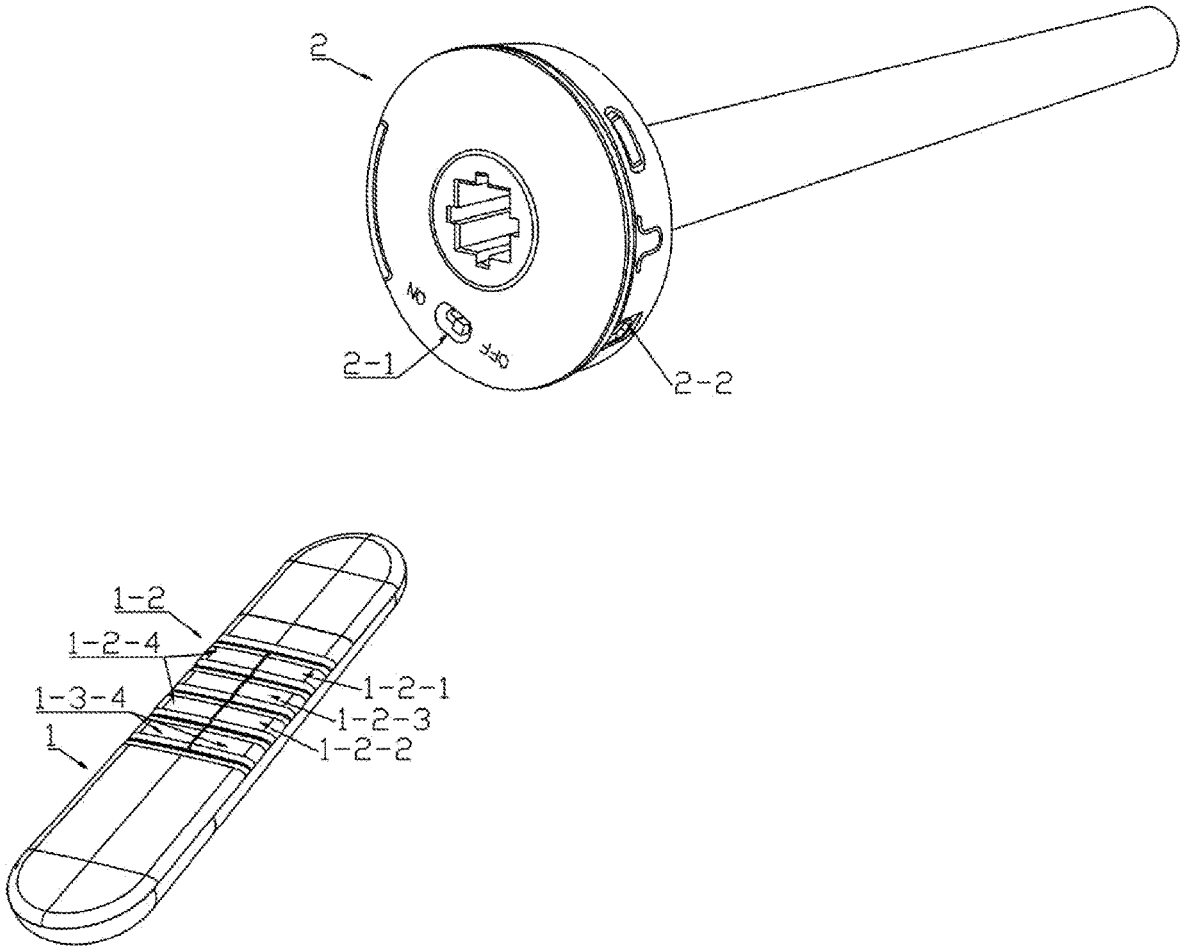
FIG. 1 is a schematic structural diagram of the curtain remote controller and the driving motor according to embodiment one of the present invention.
Figure 2:
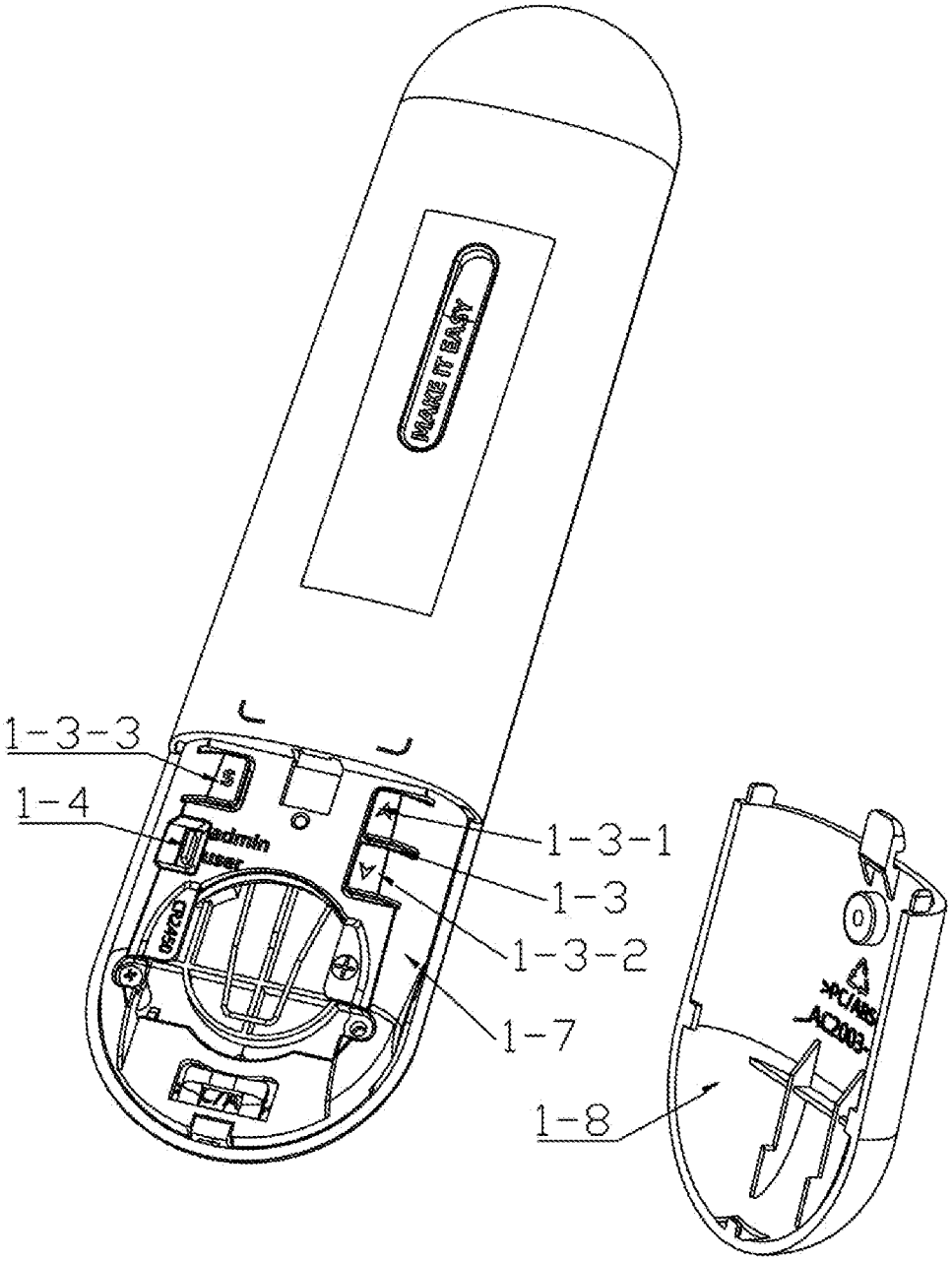
FIG. 2 is a schematic structural diagram of the back surface of the curtain remote controller according to embodiment one of the present invention.
Figure 3:
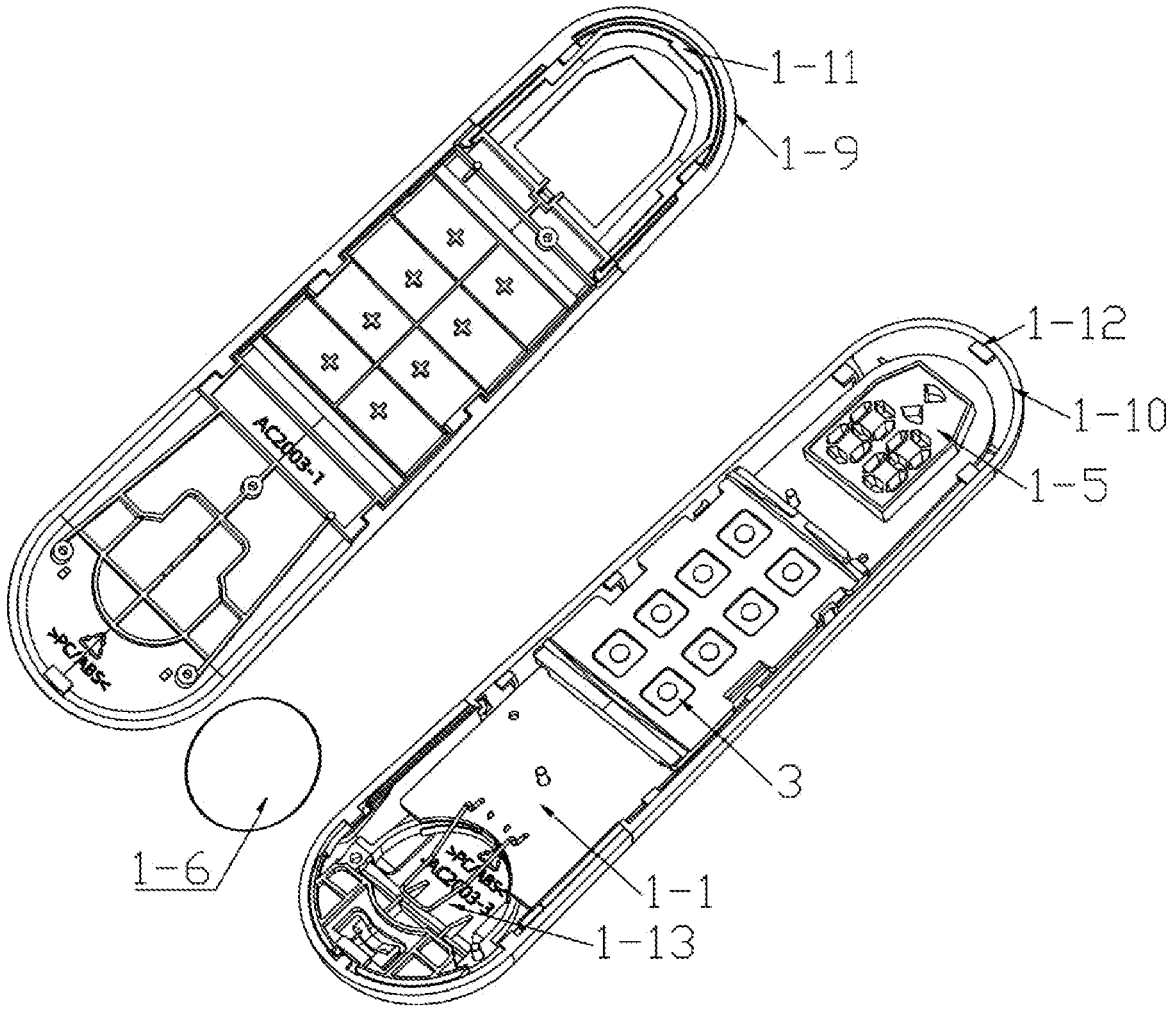
FIG. 3 is a schematic diagram of an internal structure of the curtain remote controller according to embodiment one of the present invention.

As referred in FIGS. 1-3, the invention provides a curtain remote controller, comprising a remote controller body 1, and the curtain remote controller body 1 is provided with a circuit board 1-1, a remote-control button 1-2, a managing button 1-3 and a conversion switch 1-4 for switching the function modules of the curtain remote controller; the conversion switch 1-4, the remote-control button 1-2 and the managing button 1-3 are all connected with the circuit board 1-1; the circuit board 1-1 is provided with a trigger component 3 corresponding to the remote-control buttons 1-2 and the managing button 1-3; the remote-control button 1-2 and the managing button 1-3 are both connected with the circuit board 1-1 through the trigger component 3; the remote-control buttons 1-2 comprise a go-up button 1-2-1, a go-down button 1-2-2, a stop button 1-2-3 and a light-adjusting button 1-2-4; the managing buttons 1-3 comprise at least one stroke button, an S control button 1-3-3, and a channel button 1-3-4 for switching signal channels, and the channel button 1-3-4 is arranged on the front surface of the curtain remote controller body 1. In this embodiment, the curtain remote controller body 1 is provided with two stroke buttons which include an upper stroke button 1-3-1 and a lower stroke button 1-3-2 for setting the curtain to stop at a fixed point, and the channel button 1-3-4 is arranged on the front surface of the curtain remote controller body 1.

The curtain remote controller 1 further comprises a driving motor 2 for controlling the lifting of the curtain, and the driving motor 2 is provided with a signal receiver for frequency-to-frequency connection, and an M control button 2-2 for entering the pairing mode; the curtain remote controller body 1 is provided with a display screen 1-5 and a power supply 1-6 and a signal transmitter for frequency-to-frequency connection; the signal transmitter, the display screen 1-5 and the power supply 1-6 are connected with the circuit board 1-1; a mounting part 1-7 is integrally formed on the back surface of the curtain remote controller body 1; the conversion switch 1-4 and the managing button 1-3 are arranged at the mounting part 1-7; a mounting cover 1-8 is detachably connected to the mounting part 1-7; the remote-control button 1-2 is arranged on the front surface of the curtain remote controller body 1; with the arrangement of the remote-control button 1-2 and the managing button 1-3 on the front and back surface of the remote control body 1 respectively, the functions of the remote-control buttons 1-2 can be clearly separated so as to prevent the user from using the buttons incorrectly; moreover, by hiding the managing button 1-3 on the back surface of the curtain remote controller body 1, potential misoperation of a child may be avoided. The conversion switch 1-4 comprises an admin interface for entering an administrator mode and a user interface for entering a user mode; the admin interface and the user interface of the conversion switch 1-4 are connected with the circuit board 1-1.

In addition, the curtain remote controller body 1 comprises an upper cover shell 1-9 and a lower cover shell 1-10; the inner periphery of the upper cover shell 1-9 is provided with a clamping groove 1-11, and the lower cover shell 1-10 is integrally provided with a block 1-12 corresponding to the clamping grooves 1-11, whereby the upper cover shell 1-9 and the lower cover shell 1-10 are buckled together through the matching of the clamping grooves 1-11 and the block 1-12. Meanwhile, the circuit board 1-1 is fixed to the inner surface of the upper cover shell 1-9 through bolts; the inner surface of the lower cover shell 1-10 is integrally and convexly provided with a limiting block corresponding to the two sides of the circuit board 1-1, and the periphery of the circuit board 1-1 is provided with a limiting slot corresponding to the limiting block; the power supply 1-6 is located at the lower end of the circuit board 1-1, and the mounting part 1-7 is provided with a mounting slot 1-13 corresponding to the power supply 1-6; the groove wall of the mounting slot 1-13 is integrally and convexly provided with two symmetrical limiting clamping blocks.

The method for setting remote control stroke of the above remote controller comprises the following steps:

S1, connect the curtain remote controller and the driving motor 2 for pairing and matching.

S2, select the admin interface with the conversion switch 1-4 to make the curtain remote controller enter the administrator mode, and then set the upper stroke point of the curtain upper limit and the lower stroke point of the curtain lower limit through the driving motor 2 controlled by the upper stroke button 1-3-1 and the lower stroke button 1-3-2 on the curtain remote controller.

S3, select the user interface with the conversion switch 1-4 to make the curtain remote controller enter the user mode, and then control the driving motor with the go-up button 1-2-1, the go-down button 1-2-2, the stop button 1-2-3 and the light-adjusting button 1-2-4 on the curtain remote controller to drive the curtain to ascend, descend or stop.

The specific content of the pairing and matching connection of the curtain remote controller and the driving motor 2 in the S1 comprises:

S11, connect the driving motor 2 to a power supply, and turn on the power switch 2-1, then press and hold the M control button 2-2 for 2 seconds to control the driving motor 2 to enter the pairing state and the driving motor 2 rotates back and forth for once as a feedback signal to indicate successful frequency connection between the curtain remote controller and the driving motor 2.

S12, select the admin interface with the conversion switch 1-4 to enter the administrator mode, and select a channel that needs to be matched with the corresponding driving motor 2 for frequency matching with the channel button 1-3-4 on the curtain remote controller; then press and hold the S control button 1-3-3 for 2 seconds; the pairing and matching connection of the curtain remote controller and the driving motor 2 is completed, and the driving motor 2 also rotates back and forth for once as a feedback of the successful frequency matching connection.

The specific content to set the stroke point through the driving motor 2 remotely controlled by the stroke buttons on the curtain remote controller in S2 comprises:

S21, select the admin interface with the conversion switch 1-4 to make the curtain remote controller enter the administrator mode.

S22, control the driving motor 2 to drive the curtain to rise to the desired upper stroke point with the go-up button 1-2-1 and stop, then long press the upper stroke button 1-3-1 for 2 seconds, and the driving motor 2 rotates back and forth for once as a feedback indicating that the upper stroke point is successfully set.

S23, control the driving motor 2 to drive the curtain to descend to the desired lower stroke point with the go-down button 1-2-2 and stop; then long press the lower stroke button 1-3-2 for 2 seconds, and the driving motor rotates back and forth for once as a feedback indicating that the lower stroke point is successfully set.

S24, finally, select the user interface with the conversion switch 1-4 to make the curtain remote controller enter the user mode, the stroke setting of the driving motor 2 controlled by the curtain remote controller is successfully saved. In addition, a third stroke point can be further set by the curtain remote controller if required:

Select the user interface with the conversion switch 1-4 to make the curtain remote controller enter the user mode.

Adjust the curtain to a commonly used position for sun-shading effect, such as a position of 50% height, through the go-up button 1-2-1, the go-down button 1-2-2 and the stop button 1-2-3.

Long press the upper stroke button 1-3-1 and the lower stroke button 1-3-2 at the same time for 2 seconds, and the driving motor 2 rotates back and forth for once as a feedback indicating that the third stroke point is successfully created.

If the position of the third stroke point needs to be changed, the user can adjust it to the other point with the go-up button 1-2-1, the go-down button 1-2-2 and the stop button 1-2-3, then long press the upper stroke button 1-3-1 and the lower stroke button 1-3-2 at the same time for a preset time duration, and the driving motor rotates back and forth for once as a feedback indicating that the third stroke point is successfully changed.

The curtain remote controller can be connected with one or more driving motors 2; by switching the channel to 0 channel through the channel buttons 1-3-4, multiple driving motors 2 are controlled by the curtain remote controller to operate at the same time to achieve a group control effect.

The driving motor 2 can be connected with one or more curtain remote controllers, and the specific connecting method is as described in S2. Under the user mode, press the S control button 1-3-3 of a curtain remote controller which has been added for twice, and then press the S control buttons 1-3-3 of a curtain remote controller which to be added for once; the driving motor 2 rotates back and forth for once to indicating that the curtain remote controller additionally added to the driving motor 2 is successfully matched and connected.

The curtain remote controller can also delete the matching with the driving motor 2, specifically, select the admin interface with the conversion switch 1-4 to enter the administrator mode, press the S control button 1-3-3 for 5 times; when the driving motor 2 rotates back and forth, it means that the curtain remote controller is disconnected from the corresponding driving motor 2.

When the curtain remote controller is connected with a plurality of driving motors 2 through multiple channels, the remaining channels can be locked and hidden, and the specific setting method is as follows:

Select the user interface with the conversion switch 1-4 to enter the user mode, and long press all the channel buttons 1-3-4 at the same time for 3 seconds, when number 15 for all the channels is displayed on the display screen 1-5, meaning the current available channel range is channel 1-channel 15; select the channel number 5 with the channel button 1-3-4, then channel 1-channel 5 are chosen to be used; press the stop button 1-2-3 to confirm. The currently available channels displayed on the display screen 1-5 are channel 1-channel 5.

Further, the speed of the driving motor 2 can also be adjusted by the curtain remote controller, and the specific operation is as follows:

Increase the speed of the driving motor 2: assuming that the speed of the driving motor 2 is at the first gear, and there are totally 3 gears of the speed of the driving motor 2; long press the go-up button 1-2-1 and the stop button 1-2-3 at the same time for 2 seconds, and the driving motor 2 rotates back and forth for twice as a signal feedback that the speed has been increased to the second gear; if continue to long press the go-up button 1-2-1 and the stop button 1-2-3 at the same time for 2 seconds, the driving motor 2 rotates back and forth for three times as a signal feedback that the speed has been increased from the second gear to the third gear.

Reduce the speed of the driving motor 2: assuming that the speed of the driving motor 2 is at the third gear, and there are totally 3 gears of the speed of the driving motor 2; long press the go-down button 1-2-2 and the stop button 1-2-3 at the same time for 2 seconds, and the driving motor 2 rotates back and forth for twice as a signal feedback that the speed has been reduced to the second gear; if continue to long press t the go-down button 1-2-2 and the stop button 1-2-3 at the same time for 2 seconds, the driving motor 2 rotates back and forth for once as a signal feedback that the speed has been reduced from the second gear to the first gear.

By repeatedly short pressing the M control button 2-2 of the driving motor 2, the driving motor 2 rotates forward-stop-reverse-stop in a cycle; if the M control button 2-2 is long pressed for 2 seconds, the driving motor 2 will rotate back and forth for once, and the driving motor 2 will enter the pairing state, which is valid within 10 seconds; if the M control button 2-2 is long pressed for 10 seconds, the driving motor 2 will rotate back and forth for three times, and then the driving motor 2 will reverse; if the M control button 2-2 is long pressed for 15 seconds, the driving motor 2 will rotate back and forth for four times, and the driving motor 2 will be restored to the factory settings.

Embodiment Two

Figure 4:
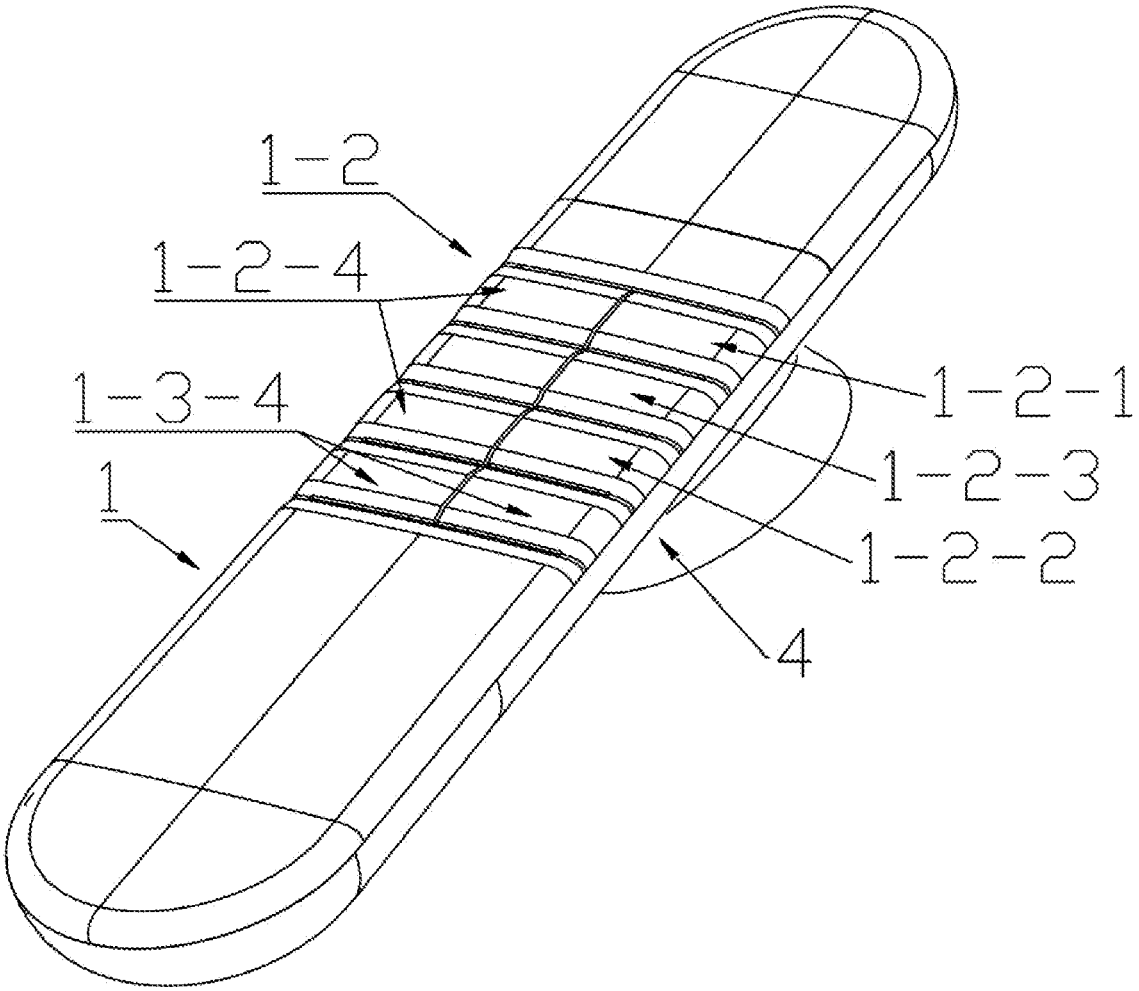
FIG. 4 is a schematic structural diagram of the curtain remote controller according to embodiment two of the present invention.

As shown in FIG. 4, the present embodiment differs from the embodiment 1 in that an acceleration sensor is further arranged in the curtain remote controller body 1; the acceleration sensor is connected with the display screen 1-5 through the circuit board 1-1; whether the terminal has a single-direction motion change trend is judged based on multiple continuous acceleration data; enabling the screen to be turned on while picking up the curtain remote controller body 1, so as to prevent the user from inconvenience when operate in a dark environment.

The outer surface of the lower cover shell 1-10 is integrally provided with a base 4 and a mounting seat matched with the base 4; the mounting seat can be fixedly installed onto the wall body; the curtain remote controller body 1 can be installed on the wall by matching the mounting seat with the base 4, thus the user can choose either wall-mounted remote control or hand-held remote control, which also solves the problem that the handheld remote control is easily littered.

In the abovementioned embodiment, the signal feedback form of the driving motor 2 to the user is that the driving motor 2 rotates back and forth, and other kind of prompt signal feedbacks can be adopted in the present invention such as in the form of flashing of an indicator light, buzzer, and etc. according to actual curtain type.

Although certain embodiments have been illustrated and described herein for purposes of description, a wide variety of alternate and/or equivalent embodiments or implementations calculated to achieve the same purposes may be substitute for the embodiments shown and described without departing from the scope of the present disclosure. This application is intended to cover any adaptations or variations of the embodiments discussed herein. Therefore, it is manifestly intended that embodiments described herein be limited only by the claim and the equivalents thereof.

The invention claimed is:

1. A method for setting remote control stroke of the curtain remote controller, comprising the following steps:

S1, pairing and matching a curtain remote controller and a driving motor;

S2, selecting an admin interface with a conversion switch to make the curtain remote controller enter an administrator mode, and then setting an upper stroke point of a curtain upper limit and a lower stroke point of a curtain lower limit through the driving motor controlled by an upper stroke button and a lower stroke button on the curtain remote controller;

S3, selecting a user interface with the conversion switch to make the curtain remote controller enter a user mode, and then controlling the driving motor with a go-up button, a go-down button and a stop button on the curtain remote controller to allow upward movement, downward movement, and stop of a curtain;

wherein the step of pairing and matching the curtain remote controller and the driving motor comprises:

S11, connecting the driving motor to a power supply, then pressing and holding a M control button for a first preset time duration to control the driving motor to enter a pairing state, wherein the driving motor rotates back and forth for once as a feedback signal to indicate successful frequency connection between the curtain remote controller and the driving motor;

S12, selecting the admin interface with the conversion switch to enter the administrator mode, and selecting a channel that needs to be matched with the driving motor for frequency matching by a channel button on the curtain remote controller; then pressing and holding a S control button for a predetermined time duration until the curtain remote controller and the driving motor is paired and matched, and at the same time the driving motor rotates back and forth for once as an indication feedback of the successful frequency matching.

2. The method for setting remote control stroke of the curtain remote controller of claim 1, wherein the step of setting the stroke point through the driving motor remotely controlled by the stroke buttons on the curtain remote controller in S2 comprises:

S21, selecting the admin interface with the conversion switch to make the curtain remote controller enter the administrator mode;

S22, controlling the driving motor to drive the curtain to rise to a desired upper stroke point with the go-up button and stop, then long pressing the upper stroke button for a second preset time duration; wherein the driving motor (2) rotates back and forth for once as a feedback indicating that the upper stroke point is successfully set;

S23, controlling the driving motor to drive the curtain to descend to a desired lower stroke point with the go-down button and stop; then long pressing the lower stroke button for a third preset time duration; wherein the driving motor rotates back and forth for once as a feedback indicating that the lower stroke point is successfully set;

S24, selecting the user interface with the conversion switch to make the curtain remote controller quit the administrator mode and enter the user mode, and saving the stroke setting of the driving motor controlled by the curtain remote controller.

3. The method for setting remote control stroke of the curtain remote controller of claim 2, wherein a third stroke point is set by the curtain remote controller; the method comprises:

selecting the user interface with the conversion switch to make the curtain remote controller enter the user mode;

adjusting the curtain to a commonly used position for sun-shading effect through the go-up button, the go-down button and the stop button;

long pressing the upper stroke button and the lower stroke button at the same time for a fourth preset time duration; wherein driving motor rotates back and forth for once as a feedback indicating that the third stroke point is successfully created.

4. The method for setting remote control stroke of the curtain remote controller of claim 3, wherein the curtain remote controller is capable of disconnecting with the driving motor by the following steps;

selecting the admin interface with the conversion switch to enter the administrator mode, pressing the S control button for a preset times, wherein the driving motor rotating back and forth indicates that the curtain remote controller is disconnected from the corresponding driving motor.

5. The method for setting remote control stroke of the curtain remote controller of claim 4, wherein a speed of the driving motor is adjustable by the curtain remote controller;

a step of increasing the speed of the driving motor comprises: long pressing the go-up button and the stop button at the same time for a fifth preset time duration, and the driving motor gives a signal feedback that the speed has been increased successfully;

a step of reducing the speed of the driving motor comprises: long pressing the go-down button and the stop button (1-2-3) at the same time for a sixth preset time duration, and the driving motor gives a signal feedback that the speed has been reduced successfully.

* * * * *